US005983780A

United States Patent [19]

Nakamoto et al.

[11] Patent Number: 5,983,780

[45] **Date of Patent: *Nov. 16, 1999**

[54] MULTIPLE PISTON SWASH PLATE TYPE OF COMPRESSOR INCLUDING DIFFERENT DEAD VOLUMES OF THE CYLINDER BORES BY THE USE OF DIFFERENT LENGTH PISTONS

[75] Inventors: Akira Nakamoto; Kazuhiro Nomura; Takanori Okabe; Naofumi Kimura; Hayato Ikeda; Hiroyuki Gennami; Hisato Kawamura, all of Kariya; Junichi Toyama, Nagoya, all of Japan

[73] Assignee: Kabushiki Kaisha Toyoda Jidoshokki Seisakusho, Aichi-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/746,920

[22] Filed: Nov. 18, 1996

[30] Foreign Application Priority Data

Nov. 20, 1995 [JP] Japan ..... 7-301698

[51] Int. Cl.[6] ..... F01B 7/18

[52] U.S. Cl. ..... 92/71; 417/269; 417/277

[58] Field of Search ..... 417/269, 277, 417/275; 92/71

[56] References Cited

U.S. PATENT DOCUMENTS 5,002,466 3/1991 Inagaki ..... 417/269
5,207,078 5/1993 Kimura et al. ..... 417/269
5,417,552 5/1995 Kayukawa et al. ..... 417/269
5,809,865 9/1998 Ikeda et al. ..... 417/269

FOREIGN PATENT DOCUMENTS 1-116292 5/1989 Japan .
1-160180 11/1989 Japan ..... 92/71
7-279839 10/1995 Japan .

*Primary Examiner*—Timothy Thorpe
*Assistant Examiner*—Cheryl J. Tyler
*Attorney, Agent, or Firm*—Morgan & Finnegan, L.L.P.

[57] ABSTRACT

A compressor includes front and rear cylinder blocks, a drive shaft rotatably supported by the cylinder blocks, a swash plate mounted on the drive shaft, a plurality of cylinder bores defined in the cylinder blocks and located around the drive shaft, and a plurality of pistons respectively disposed in the cylinder bores. The pistons reciprocate by converting rotation of the drive shaft with the swash plate. A plurality of compression chambers are defined in the cylinder bores for compressing the gas supplied to the cylinder bores in accordance with the reciprocating movement of the pistons. Each compression chamber has dead volume defined by a space having a predetermined volume when the associated piston is at top dead center in each cylinder bore. A reference capacity is defined by the capacity when the piston is at a bottom dead center of the cylinder bore that has the smallest dead volume. The largest dead volume is greater than the minimum dead volume by approximately four percent of the reference capacity.

17 Claims, 8 Drawing Sheets

MULTIPLE PISTON SWASH PLATE TYPE OF COMPRESSOR INCLUDING DIFFERENT DEAD VOLUMES OF THE CYLINDER BORES BY THE USE OF DIFFERENT LENGTH PISTONS

BACKGROUND OF THE INVENTION

1. Field of the Invention

The present invention relates to reciprocating piston type compressors such as those employing swash plates, and more particularly, to reciprocating piston type compressors that enable reduction of vibration and noise.

2. Description of the Related Art

Piston type compressors are generally mounted on vehicles to air-condition passenger compartments. A typical piston type compressor has a crank chamber, which is defined in a housing, and a drive shaft, which is supported in the crank chamber. The drive shaft is connected to a vehicle engine by a clutch. A plurality of cylinder bores extend parallel to and about the drive shaft in a cylinder block, which constitutes part of the housing. A piston is accommodated for reciprocation in each cylinder bore. A compression chamber is defined in each cylinder bore by the piston. A swash plate is fixed to the drive shaft and rotates integrally with the shaft. Rotation of the swash plate is converted to linear reciprocation of each piston. The reciprocation of each piston compresses the refrigerant gas in each compression chamber.

The compressing motion of each piston causes a compression reaction to act on the piston. The compression reaction is transmitted to the drive shaft through the swash plate and causes fluctuation of the drive shaft torque. The torque fluctuation produces torsional vibration between the drive shaft and the clutch. This generates vibrations and noise. When analyzing the sum of the torque fluctuations, that is, the sum of each compression reaction produced in the compression chambers, using a fast Fourier transform (FFT), it is apparent that the torque fluctuation occurs cyclically. It is also apparent that the torque fluctation includes a wide variety of frequency components ranging from zero cycles to a large number of cycles. Among the frequency components, the main component is the n cycle component, which corresponds to the number (n) of the cylinder bores. The n cycle component corresponds to the vibration component that occurs cyclically n number of times during a single rotation of the drive shaft. For example, a ten cycle component corresponds to the vibration component that takes place cyclically ten times during a single rotation of the drive shaft. When the frequency of the n cycle component is close to the vibration frequency of the compressor and its peripheral equipment, resonance phenomena produces noise that may be transmitted to the passenger compartment.

Japanese Unexamined Utility Model Publication No. 1-160180 describes a variable displacement compressor employing a wobble type swash plate. The compressor is provided with five cylinder bores. The distances between adjacent cylinder bores are not equal. Furthermore, the dead volume (the volume of the compression chamber when the piston is located at the top dead center) in the compression chamber of one of the cylinder bores differs from the dead volume in the other cylinder bores. The top end of one of the pistons is shortened for a predetermined length to increase its associated dead volume. This alters the volume and pressure of the compression chamber. The increase in the dead volume reduces the compression reaction produced in the compression chamber and enables the sum of the compression reactions acting on the swash plate to always be constant. Therefore, the swash plate rotates smoothly due to the decrease in the torque fluctuation of the drive shaft. As a result, the generation of torsional vibration and noise is decreased.

However, the compressor of the above publication merely changes the dead volume of one or more cylinder bores to decrease the torsional vibrations and noise of the compressor. In addition, the above publication does not teach how to further decrease the torque fluctuation of the drive shaft. Therefore, when applying the device of the publication to various types of compressors, the decrease in the torque fluctuation of the drive shaft may be insufficient. Thus, the generation of vibration and noise may not be adequately suppressed.

SUMMARY OF THE INVENTION

Accordingly, it is an objective of the present invention to provide a piston type compressor that enables a decrease in the n cycle component of the torque fluctuation that corresponds to the number of cylinder bores n and thus suppresses the generation of vibrations and noise.

To achieve the above objective, a compressor for compressing a gas includes a housing, a drive shaft rotatably supported by the housing, a drive plate mounted on the drive shaft, a plurality of cylinder bores defined in the housing and located around the drive shaft, and a plurality of pistons respectively located in the cylinder bores and operably connected to the drive plate. The drive plate converts rotation of the drive shaft to reciprocating movement of the piston. The compressor further includes a plurality of compression chambers respectively defined in the cylinder bores for compressing the gas supplied to the cylinder bores in accordance with the reciprocating movement of the piston. Each compression chamber has a dead volume defined by its volume when the associated piston is at a top dead center position. One of the compression chambers has a dead volume that is smaller than that of the other compression chambers, and one of the compression chambers has a dead volume that is larger than that of the others. A reference volume is defined by the volume of the cylinder bore that has a minimum dead volume when the associated piston is at a bottom dead center position. The dead volume of the chamber having the largest dead volume is greater than the dead volume of the chamber having the smallest dead volume by one or more percent of the reference volume.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A double-headed piston type compressor employing a swash plate will hereafter be described with reference to FIGS. 1–6.

Figure 1:
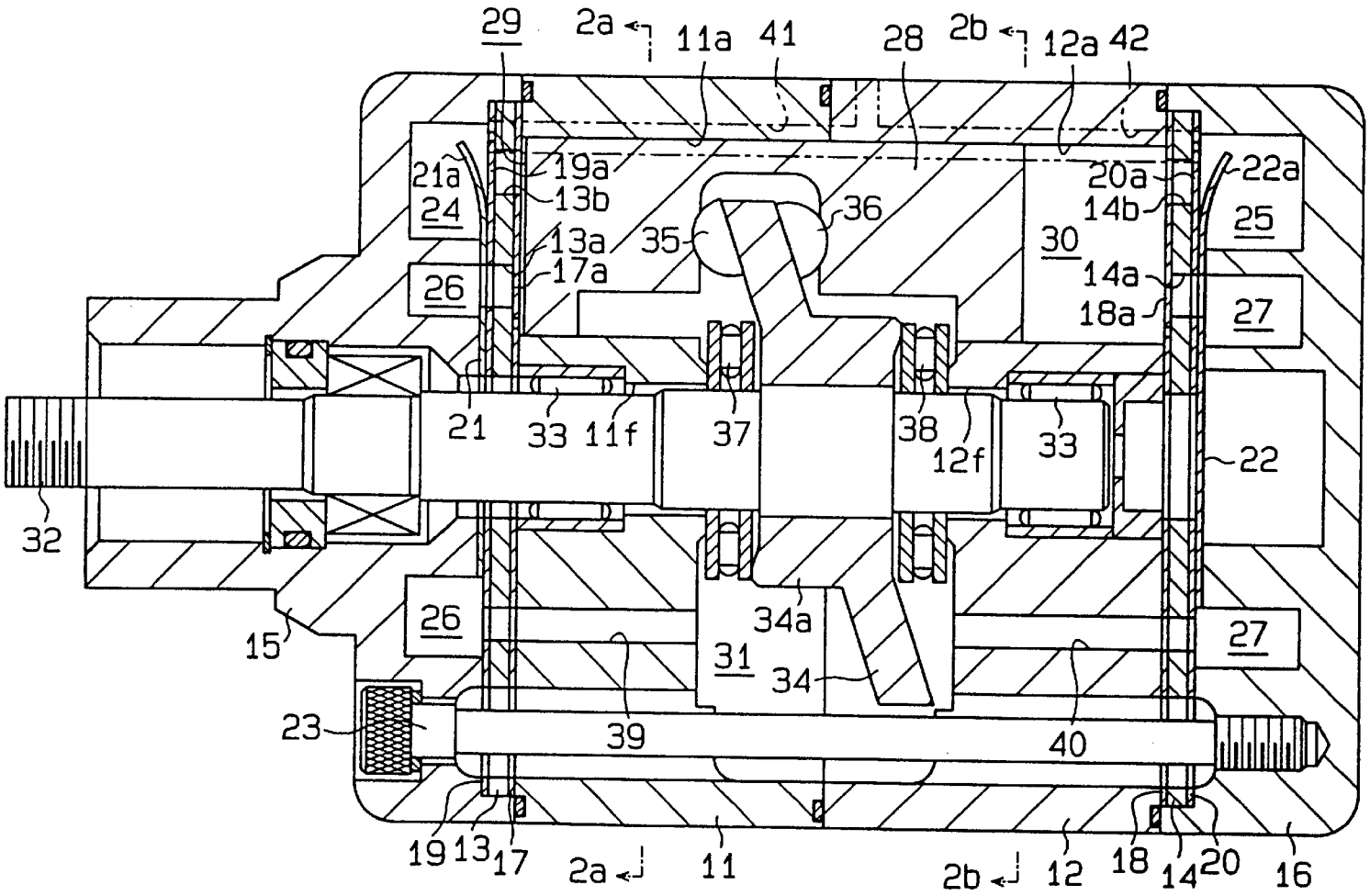
FIG. 1 is a cross-sectional view showing a compressor according to a first embodiment of the present invention.

As shown in FIG. 1, a front cylinder block 11 and a rear cylinder block 12 are coupled to each other at their opposed ends. A front housing 15 is coupled to the front end of the front cylinder block 11 with a valve plate 13 arranged therebetween. A rear housing 16 is coupled to the rear end of the rear cylinder block 12 with a valve plate 14 arranged therebetween. First plates 17, 18, in which suction valves 17*a*, 18*a* are defined, are arranged between the cylinder blocks 11, 12 and the housings 15, 16, respectively. Second plates 19, 20, in which discharge valves 19*a*, 20*a* are defined, are arranged between the valve plates 12, 14 and the housings 15, 16, respectively. Third plate 21, 22, in which retainers 21*a*, 22*a* are defined, are arranged between the second plates 19, 20 and the housings 15, 16, respectively. The retainers 21*a*, 22*a* restrict the opening of the suction valves 19*a*, 20*a*, respectively.

Figure 2A:
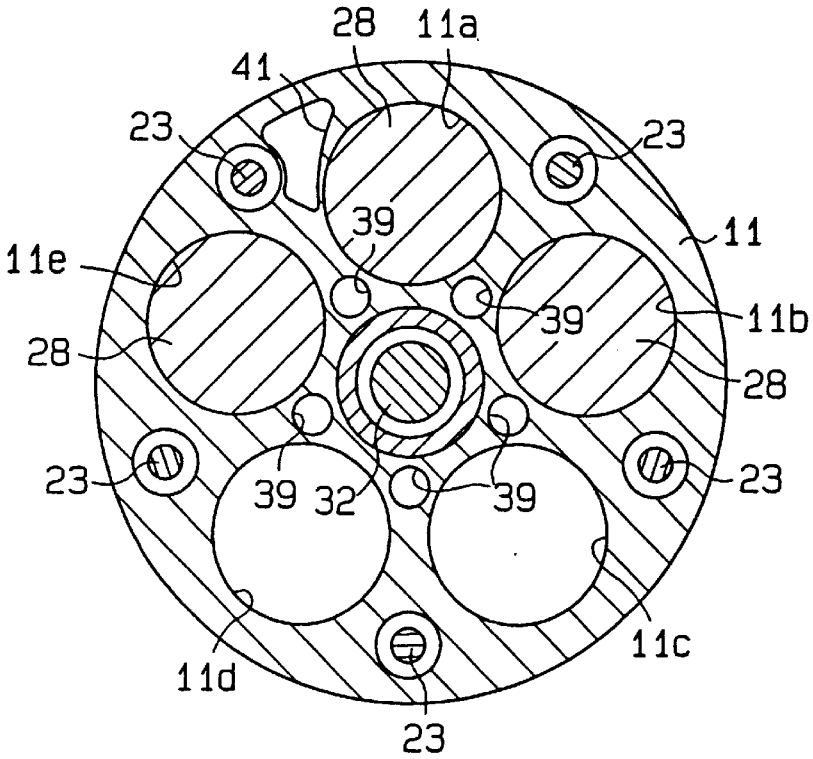
FIG. 2A is a cross-sectional view taken along line 2*a*—2*a* in FIG. 1.
Figure 2B:
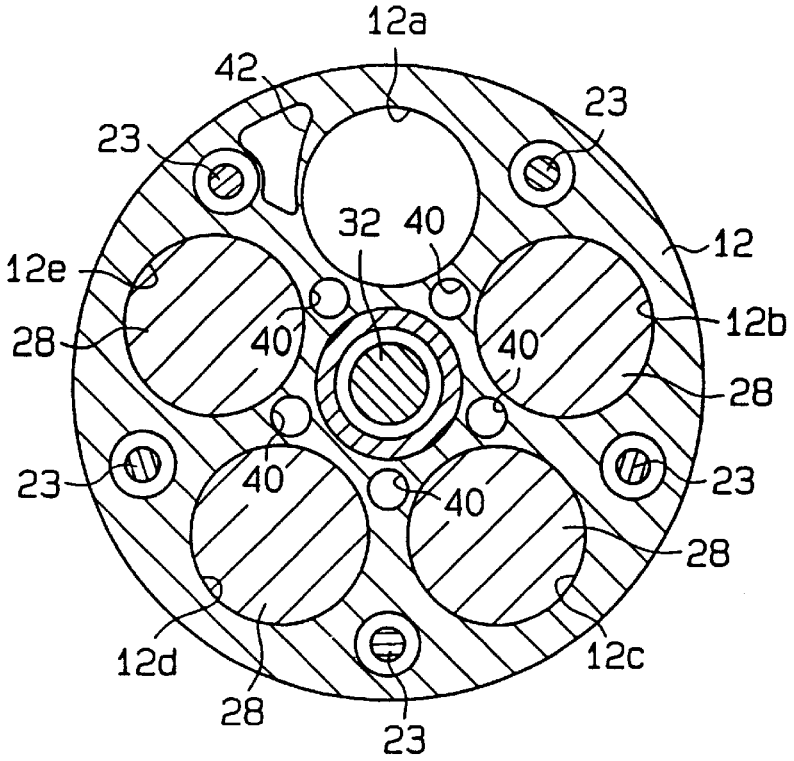
FIG. 2B is a cross-sectional view taken along line 2*b*—2*b* in FIG. 1.
Figure 3A:
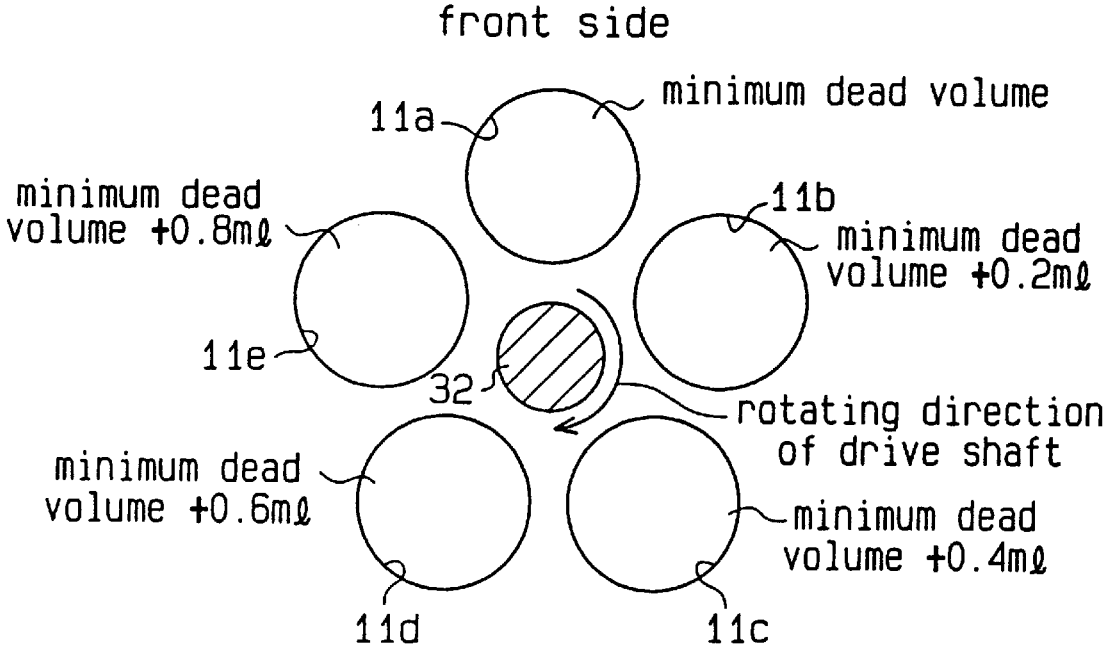
FIG. 3A is a diagrammatic drawing showing the dead volume of each compression chamber at the front side of the compressor.

As shown in FIGS. 1–3, the cylinder blocks 11, 12, the valve plates 13, 14, the housings 15, 16, the first plates 17, 18, the second plates 19, 20, and the third plates 21, 22 are fastened to one another by a plurality of bolts 23 (five in this embodiment). The bolts 23 are inserted from the front side of the front housing 15 and are screwed into threaded holes provided in the rear housing 16.

Discharge chambers 24, 25 are defined at the periphery of the front and rear housings 15, 16, respectively. Suction chambers 26, 27 are defined at the inner side discharge chambers 24, 25, respectively. As shown in FIGS. 1, 2A, and 2B, a plurality of parallel cylinder bores 11*a*, 11*b*, 11*c*, 11*d*, 11*e* extend through the front cylinder block 11 while a plurality of parallel cylinder bores 12*a*, 12*b*, 12*c*, 12*d*, 12*e* extend through the rear cylinder block 12. The cylinder bores 11*a*, 11*b*, 11*c*, 11*d*, 11*e* are aligned with the cylinder bores 12*a*, 12*b*, 12*c*, 12*d*, 12*e*, respectively. A double-headed piston 28 is accommodated in each pair of aligned cylinder bores 11*a*–11*e*, 12*a*–12*e*. The structure of this compressor thus provides ten cylinders with five pistons. In other words, each piston 28 defines front and rear compression chambers 29, 30 in its associated pair of bores 11*a*–11*e*, 12*a*–12*e*, respectively. The compression chambers 29, 30 are connected to the suction chambers 26, 27 through suction ports 13*a*, 14*a*. In the same manner, the compression chambers 29, 30 are connected to the discharge chambers 24, 25 through discharge ports 24, 25.

A crank chamber 31 is defined between the front and rear cylinder blocks 11, 12. A drive shaft 32 is rotatably supported by radial bearings 33 in shaft holes 11*f*, 12*f*, which are defined in the cylinder blocks 11, 12, respectively. The drive shaft 32 is rotated by an external drive source such as a vehicle engine by way of a clutch (not shown). A swash plate 34 is fixed to the middle of the drive shaft 32 and connected to the middle of each piston 28 by a pair of hemispheric shoes 35, 36. A thrust bearing 37 is arranged between the front surface of a boss 34*a* defined on the swash plate 34 and the opposed inner wall of the front cylinder block 11. A thrust bearing 38 is arranged between the rear surface of the boss 34*a* and the opposed inner wall of the rear cylinder block 11. Accordingly, when the drive shaft 32 rotates the swash plate 34, the rotation of the swash plate 34 is transmitted to each piston 28 by way of the associated shoes 35, 36 causing each piston 28 to reciprocate in the associated pair of cylinder bores 11*a*–11*e*, 12*a*–12*e*.

A suction passage 39 is defined in the cylinder block 11 to connect the suction chamber 26 to the crank chamber 31 while a suction passage 40 is defined in the cylinder block 12 to connect the suction chamber 27 to the crank chamber 31. The crank chamber 31 is connected to a supply pipe of an external refrigerant circuit (not shown) by way of a suction flange (not shown). Refrigerant gas circulating through the external refrigerant circuit is drawn into the crank chamber 31 through the supply pipe. A discharge passage 41 extends through the cylinder block 11 and the housing 15 to connect the discharge chamber 24 to the external refrigerant circuit by way of a discharge flange (not shown). In the same manner, a discharge passage 42 extends through the cylinder block 12 and the housing 16 to connect the discharge chamber 25 to the external refrigerant circuit by way of the discharge flange.

Each of the front and rear cylinder bores 11*a*–11*e*, 12*a*–12*e* have equal diameters. The first piston 28 accommodated in the first front and rear cylinder bores 11*a*, 12*a* has a certain length. The second to fifth pistons 28 that are accommodated in the corresponding second to fifth front and rear cylinder bores 11*b*–11*e*, 12*b*–12*e*, have front and rear heads that are each cut off and thus shortened by a predetermined length. The shortening increases gradually in correspondence with the rotating direction of the drive shaft 32. Accordingly, the distance between the surface of the head of the piston 28 and the opposed end surface of the cylinder bores 11*a*–11*e*, 12*a*–12*e* differs with each piston 28. As a result, the dead volume in each compression chamber 29, 30, that is, the volume of each compression chamber 29, 30 when the piston 28 is located at the top dead center, differs from the others.

Figure 3B:
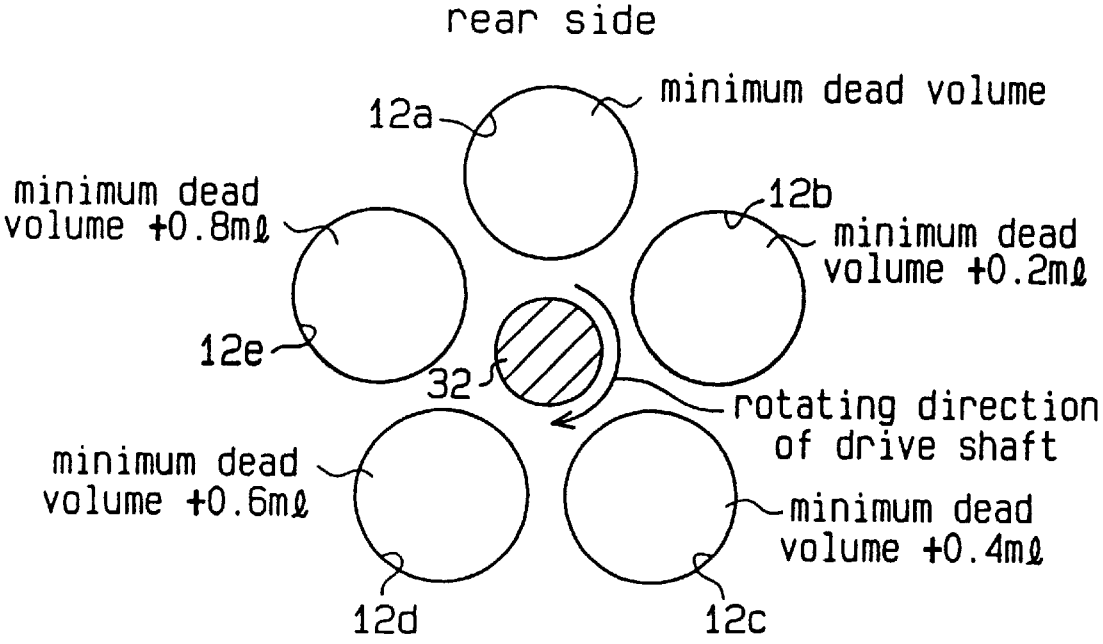
FIG. 3B is a diagrammatic drawing showing the dead volume of each compression chamber at the rear side of the compressor.

The dead volume of each of the rear compression chambers 30 will now be described. As shown in FIG. 3B, the dead volume in the compression chamber 30 of the first rear cylinder bore 12*a* is the smallest among the five bores 12*a*–12*e*. The dead volume of the compression chambers 30 gradually increases in the order of the second, third, fourth, and fifth cylinder bores 12*b*, 12*c*, 12*d*, 12*e* in the rotating direction of the drive shaft 32, which is indicated by an arrow. The increased volume of each dead volume is based on the volume in the compression chamber 30 of the first cylinder bore 12*a* when the associated first piston 28 is located at the bottom dead center. Thus, the dead volume associated with the first piston will hereafter be referred to as the reference volume. The reference volume is exemplified here as 20 milliliters (ml). The dead volume in each rear cylinder bore 12*b*–12*e* is increased, for example, by 0.2 ml (one percent of the reference volume) in each successive bore 12*a*–12*d* in the rotating direction of the drive shaft 32. Hence, the dead volume in the fifth cylinder bore 12*e*, which is the greatest among the five bores 12*a*–12*e* is increased by 0.8 ml in comparison with the first cylinder bore 12*a*.

Figure 9:
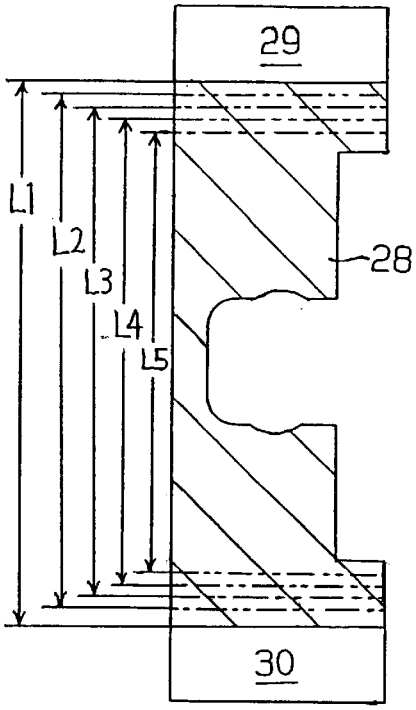
FIG. 9 is a cross-sectional view of a piston with a plurality of exemplary lengths L1 to L2 shown.
Figure 10:
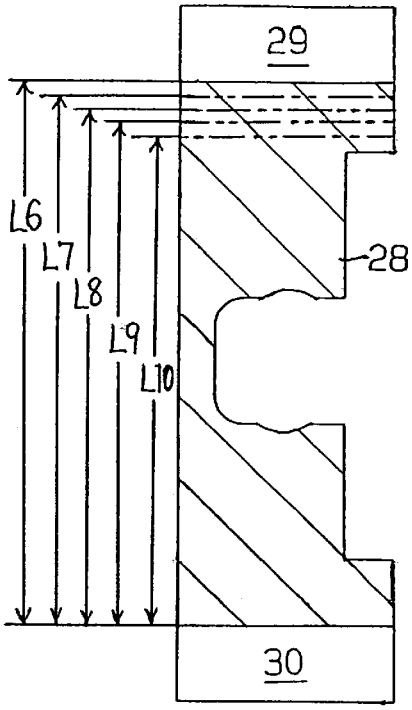
FIG. 10 is a cross-sectional view of a piston with a plurality of exemplary lengths L6 to L10 shown.

FIG. 9 is a cross-sectional view of a piston 28, showing a plurality of exemplary, progressively decreasing lengths L1–L5. FIG. 10 shows an alternative configuration for the piston, discussed further, below. The shortened depth at the front side of each piston 28 is equal to the shortened depth at the rear side of the same piston 28. Therefore, in each pair of cylinder bores 11*b*, 12*b*; 11*c*, 12*c*; 11*d*, 12*d*; and 11*e*, 12*e*, the dead volume in the front compression chamber 29 is equal to the dead volume in the associated rear compression chamber 30. Accordingly, in the same manner as the rear dead volumes, each of the dead volumes at the front side of the compressor gradually increases in the rotating direction of the drive shaft 32.

The operation of the compressor having the above structure will now be described. As shown in FIG. 1, rotation of the drive shaft 32 is converted to linear reciprocation of each piston 28 in the associated pair of cylinder bores 11*a*–11*e*, 12*a*–12*e*. The reciprocation of each piston 28 causes the refrigerant gas to be drawn into the crank chamber 31 through the suction flange. The refrigerant gas is then drawn into the suction chambers 26, 27 through the suction passages 39, 40 from the crank chamber 31. During the suction stroke, in which the piston 28 moves from the top dead center to the bottom dead center, the refrigerant gas in the associated suction chamber 26, 27 is drawn into the compression chamber 29, 30 through the suction ports 13*a*, 14*a*, respectively. Afterwards, during the compression-discharge stroke, in which the piston 28 moves from the bottom dead center to the top dead center, the refrigerant gas in the associated compression chamber 29, 30 is compressed. When the refrigerant gas is pressurized to a predetermined level, the associated discharge valve 19*a*, 20*a* is opened to release the refrigerant gas into the discharge chamber 24, 25, through the discharge ports 13*b*, 14*b*, respectively. The refrigerant gas in the suction chambers 24, 25 is then sent to the external refrigerant circuit through the discharge passages 41, 42, respectively, to air-condition the passenger compartment.

Figure 6A:
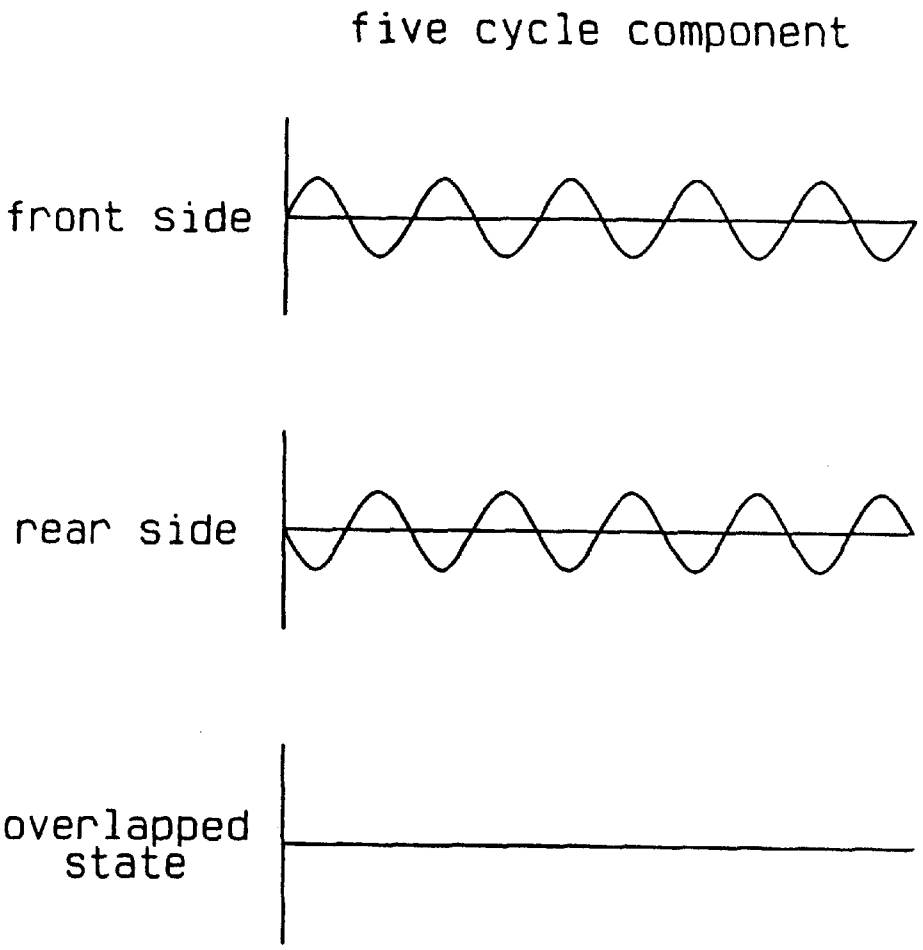
FIG. 6A shows the overlapping phenomenon of the five cycle component of the sums of the front and rear sides of a prior art compressor.
Figure 6B:
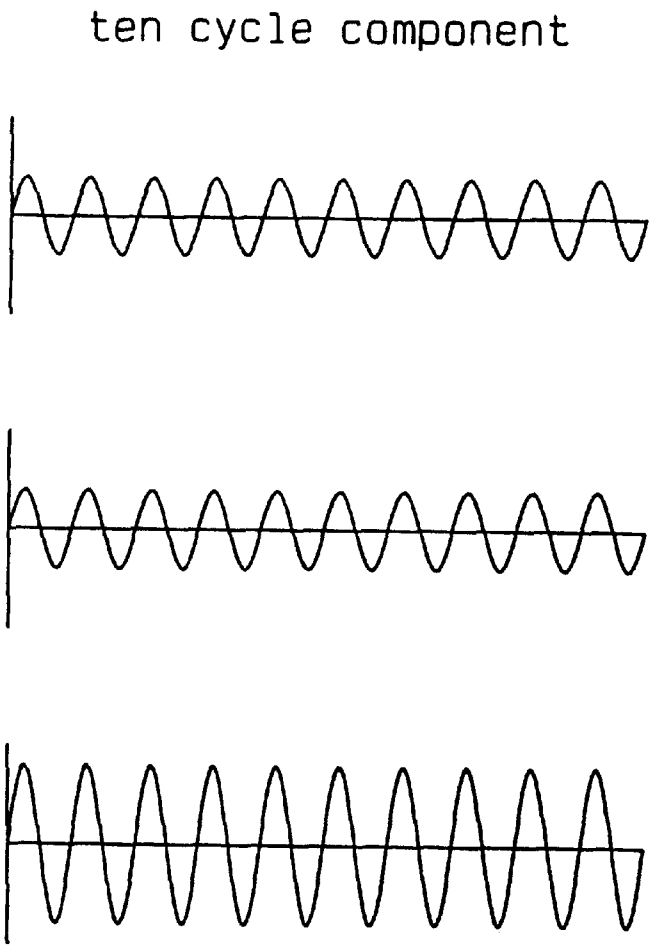
FIG. 6B shows the overlapping phenomenon of the ten cycle component of the sums of the front and rear sides of a prior art compressor.

FIG. 6A shows a five cycle component of vibrations at the front side and the rear side of a ten-cylinder double-headed prior art piston type compressor that has equal dead volumes in each cylinder bore. The five cycle component is produced by vibrations caused by torque fluctuation during a single rotation of the drive shaft. FIG. 6B shows a ten cycle component of the vibrations at the front side and the rear side of the same compressor. In double-headed piston type compressors, the phase of the compression reaction is offset 180 degrees when comparing the sum at the front side (the sum of the compression reactions in each of the five cylinder bores) and the sum at the rear side (the sum of the compression reactions in of each of the five cylinder bores). This is due to the movement of the piston 28 from the top dead center in the front of the compressor to the top dead center in the rear of the compressor when the drive shaft 32 is rotated 180 degrees.

FIG. 6B shows the ten cycle component caused by the torque fluctuation of the drive shaft 32 that is obtained by analyzing the sum of the compression reactions in each compression chamber using a fast Fourier transform. The ten cycle component is a vibration component that is generated cyclically for ten times during a single rotation of the drive shaft 32. Since the ten cycle component is generated for an even number of times, the phase of the waveform representing the front side sum coincides with the waveform representing the rear side sum. Accordingly, the added ten cycle component of the torque fluctuation at the front side and rear side of the compressor is cumulative. Thus, the ten cycle component is the main factor that causes torsional vibration between the drive shaft and the clutch. The five cycle component, which is an n/2 cycle component of the vibration, is generated cyclically for five times during a single rotation of the drive shaft. Since the five cycle component is generated for an odd number of times, the phase of the waveform representing the front side sum and the phase of the waveform representing the rear side sum are offset by 180 degrees. This causes the added five cycle components of the front and rear sides to offset and cancel each other.

Figure 5:
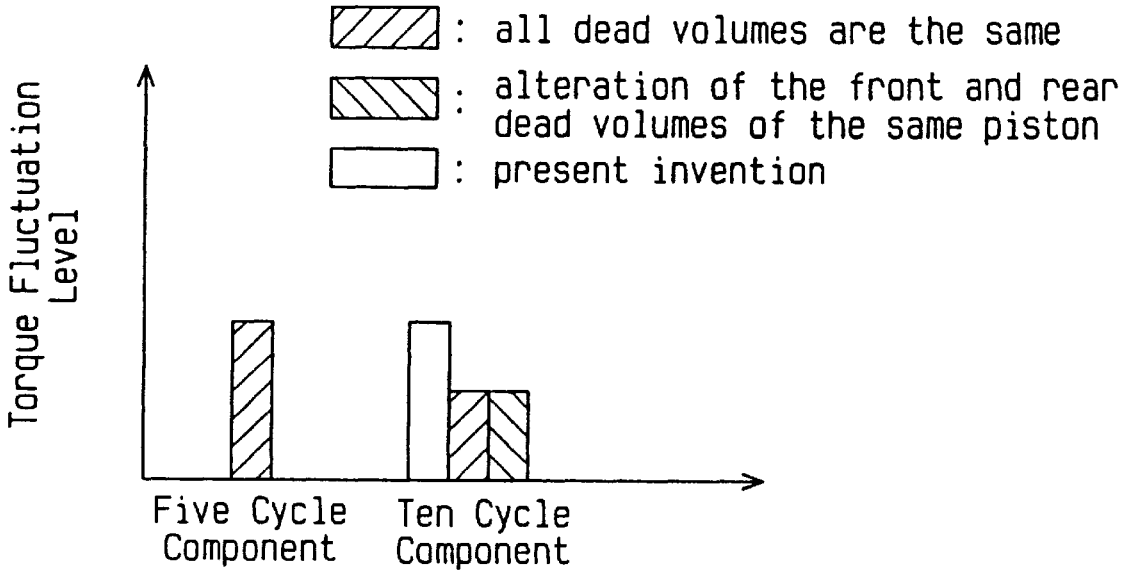
FIG. 5 is a graph showing the decrease of a ten cycle component and the alteration of a five cycle component.

To decrease the ten cycle component of the vibrations in the prior art compressor, the dead volume at the front side of each piston and the dead volume at the rear side of the same piston may differ from one another. Thus, as shown in FIG. 5, the front and rear phases of the ten cycle components are offset from one another. This reduces the ten cycle component of the vibrations. However, the phases of the five cycle component at the front and rear sides are offset from one another in the same manner as the ten cycle component. This further produces vibrations since the front and rear vibrations no longer cancel each other. Therefore, in such compressors, the five cycle components of the torque fluctuation may become a factor that increases noise.

In comparison, in the compressor of the present invention, which has five sets of different dead volumes, the difference in the dead volumes between the pairs of corresponding front and rear compression chambers 29, 30 differentiates the volumes and pressures of the pairs of compression chambers 29, 30. This offsets the phases of the ten cycle components of the torque fluctuation. Accordingly, the amplitude of the ten cycle components at the front and rear sides is decreased in comparison with a structure in which all of the dead volumes are equal.

In this embodiment, there is a difference of 0.8 ml between the maximum dead volume and the minimum dead volume. This value (0.8 ml) corresponds to four percent of the reference volume (20 ml) in the cylinder bores 11*a*, 12*a*. Such an increase of the dead volume has little effect on the compressing efficiency and performance of the pistons 28.

Each of the parts of the compressor has a dimensional tolerance. Thus, it is difficult to assemble each and every compressor with exactly the same dimensions. The dimensional difference varies the dead volume. The varied volume of the dead volume caused by such dimensional differences is less than one percent at most. The compressor according to the present invention has a difference between the maximum and minimum dead volumes that corresponds to four percent of the reference volume. Thus, despite dimensional differences, the difference in dead volumes between the pairs of cylinder bores 29, 30 is ensured. Hence, the difference between the maximum and minimum dead volumes is not limited to four percent as long as it is one percent or more of the reference volume.

Figure 4:
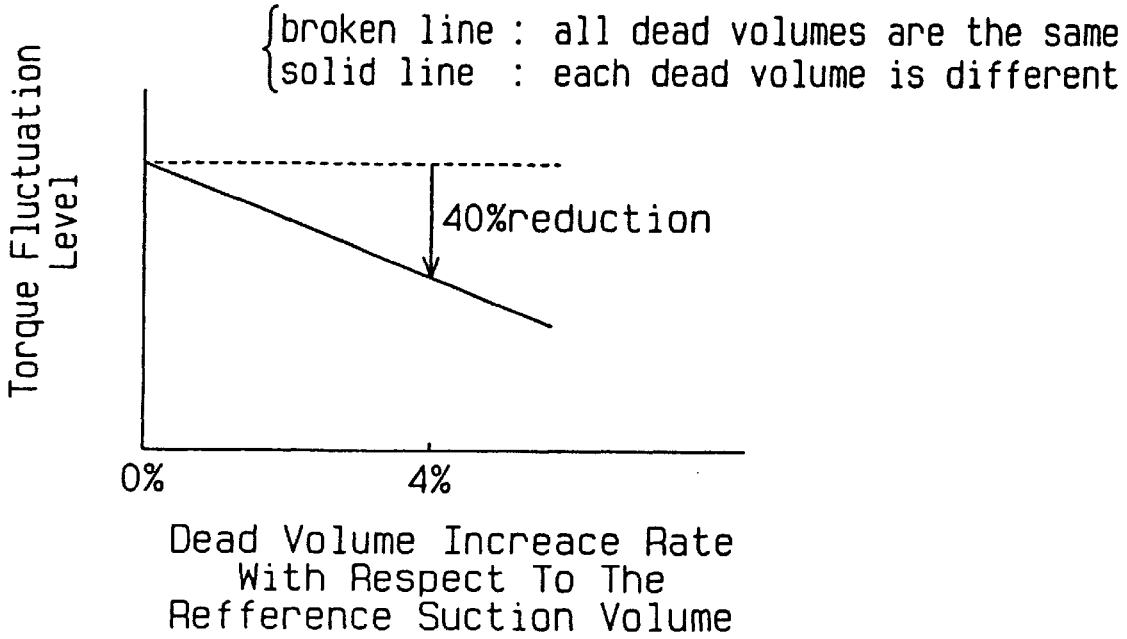
FIG. 4 is a graph showing the relationship between the increased dead volume and the torque fluctuation.

As shown in FIG. 4, in compressors having equal dead volumes, the torque fluctuation level of the ten cycle component remains substantially the same even when the dead volume is increased. In comparison, the torque fluctuation level of compressors having different dead volumes decreases in a substantially proportional manner with respect to the volume increased from the reference volume. The maximum increased dead volume corresponds to four percent of the reference volume. This enables the torque fluctuation level to be decreased drastically by about 60 percent in comparison with compressors having equal dead volumes. Thus, the structure of the present invention enables a 60 percent decrease in the torque fluctuation level in comparison with a compressor having equal dead volumes. In this manner, the compressor according to the present invention efficiently decreases the torque fluctuation level. In particular, the compressor enables an efficient decrease of the ten cycle component (the main factor that causes torsional vibrations) that corresponds to the number of cylinders. The decrease in torsional vibrations suppresses the generation of noise caused by resonance phenomena, which takes place between the compressor and its peripheral equipment. This suppresses the noise transmitted to the passenger compartment.

The dead volumes at the front and rear sides of each piston 28 are equal to each other. Thus, the phase of the front side sum is offset by 180 degrees from the phase of the rear side sum of the five cycle component. Accordingly, the front and rear side five cycle components offset and cancel each other. As a result, the five cycle components and the ten cycle components are both minimized. This suppresses the generation of noise and vibrations.

Figure 11:
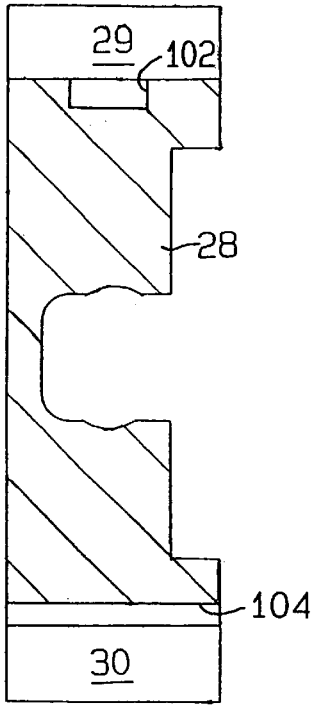
FIG. 11 is a cross-sectional view of a piston having a recess on one end and a groove on the other end.
Figure 11A:
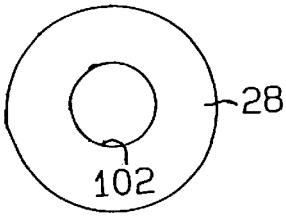
FIG. 11A is a plan view of the recess of the piston of FIG. 11.
Figure 11B:
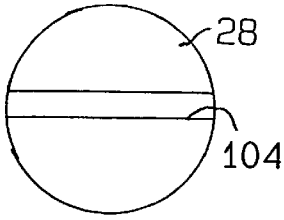
FIG. 11B is a plan view of the groove of the piston of FIG. 11.

The dead volumes need not be altered in the manner described above. For example, each dead volume may be altered by providing recesses or grooves in the head of the associated piston 28. FIG. 11 is a cross-sectional view of a double-headed piston 28 including a recess 102 and a groove 104. FIGS. 11A and 11B are further views of the recess 102 and the groove 104, respectively. As other options, each dead volume may be increased by machining the walls of the cylinder bores 11*a*–11*e*, 12*a*–12*e* or by elongating the cylinder bores. The thickness of the valve plates 13, 14 or the suction valves 17*a*, 18*a* may also be altered to vary the dead volumes.

Instead of altering the dead volume in both of the associated front and rear compression chambers 29, 30, the dead volume in only one of the chambers 29, 30 may be altered. FIG. 10 is a cross-sectional view of a double-headed piston 28 having a plurality of exemplary, progressively decreasing length L6–L10, wherein the length of the piston in the front cylinder bore decreases while the length of the piston in the rear cylinder bore stays the same.

The number of the pistons 28 is not limited to five. For example, six, eight, or twelve pistons may be employed.

The dead volume in the associated pair of front and rear compression chambers 29, 30 is not limited to five sets. For example, the compressor may have three or four sets of different dead volumes.

The difference between the maximum and minimum dead volumes may be lowered to one percent of the reference volume as long as the compressor's compressing performance is not degraded to an undesirable level. The increased volume of the dead volume is not limited as described above and may be set within a range that maintains the compressing performance within a desirable level.

The present invention may be embodied in compressors that use single-headed pistons instead of double-headed pistons.

The present invention may be embodied in compressors that employ a wave-like cam plate instead of a swash plate.

A compressor according to the second embodiment of the present invention will hereafter be described with reference to FIGS. 7A and 7B. Parts that are identical to those used in the first embodiment will be denoted with the same numerals.

In this embodiment, the increasing size order of the dead volumes in a double-headed piston type compressor having ten cylinders differs from the first embodiment. More specifically, the difference between the dead volumes is irrelevant with respect to the rotating direction of the drive shaft 32.

Figure 7A:
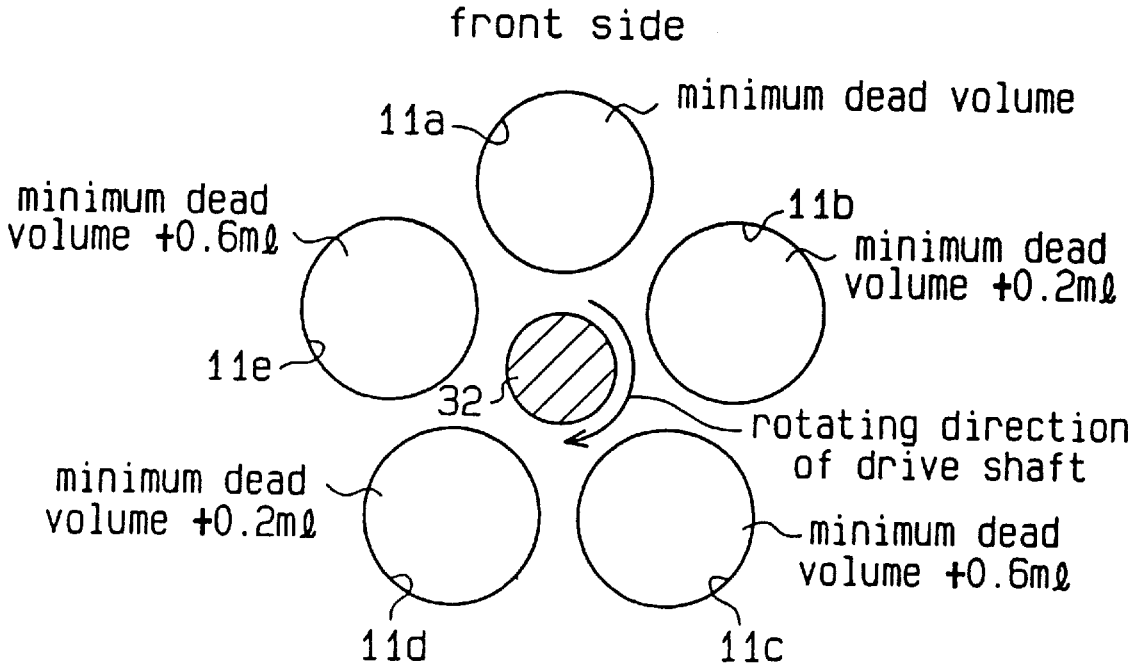
FIG. 7A is a diagrammatic drawing showing the dead volume of each compression chamber at the front side of a compressor according to a second embodiment of the present invention.
Figure 7B:
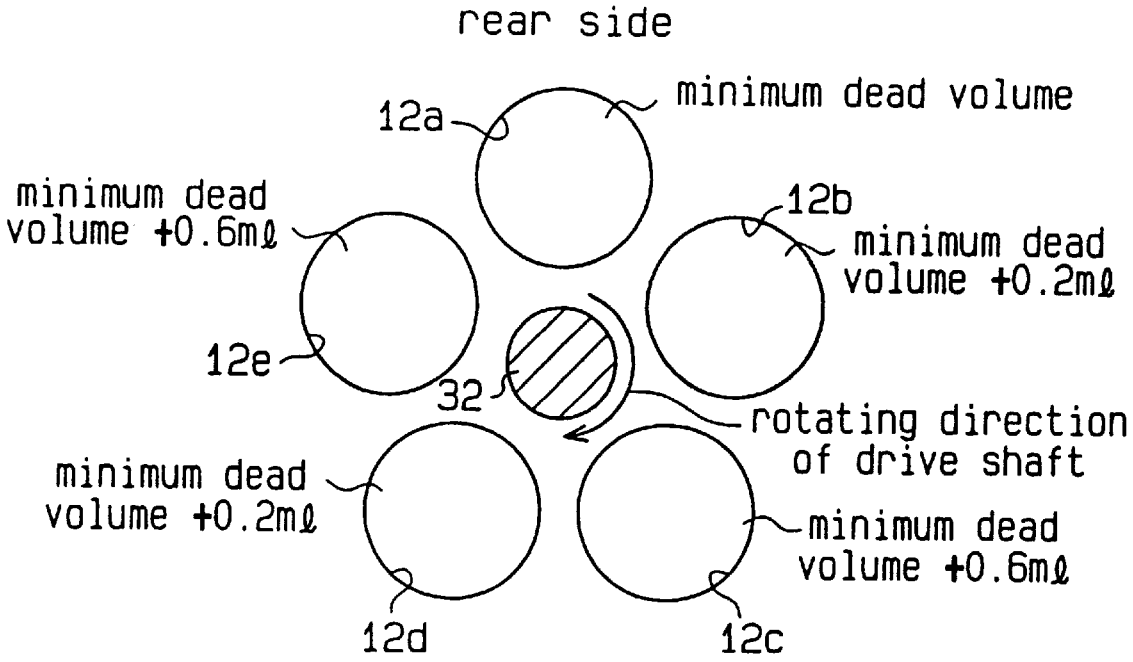
FIG. 7B is a diagrammatic drawing showing the dead volume of each compression chamber at the rear side of the compressor according to a second embodiment of the present invention.

As shown in FIGS. 7A and 7B, the dead volume in the first cylinder bore 12*a* is smallest. The reference volume in the bore 12*a* is exemplified here as 20 ml. The dead volume in the compression chamber 30 of each of the second, third, fourth, and fifth cylinder bores 12*b*, 12*c*, 12*d*, 12*e* is increased by, for example, 0.2 ml, 0.6 ml, 0.2 ml, and 0.6 ml, respectively, with respect to the minimum dead volume (reference volume). The dead volumes in each associated pair of compression chambers 29, 30 of the respective cylinder bores 11*a*–11*e*, 12*a*–12*e* are equal to each other.

This structure enables the compressor to decrease the ten cycle components of the vibrations and suppress the generation of the five cycle components.

A compressor according to a third embodiment of the present invention will hereafter be described with reference to FIG. 8A and 8B.

This embodiment also employs a double-headed piston type compressor having ten cylinders. In this compressor, the dead volume in the rear compression chamber 29 differs from the dead volume in the associated front compression chamber 30. The dead volume in each rear compression chamber 30 is obtained by adding a predetermined volume to the dead volume in the associated front compression chamber 29.

Figure 8A:
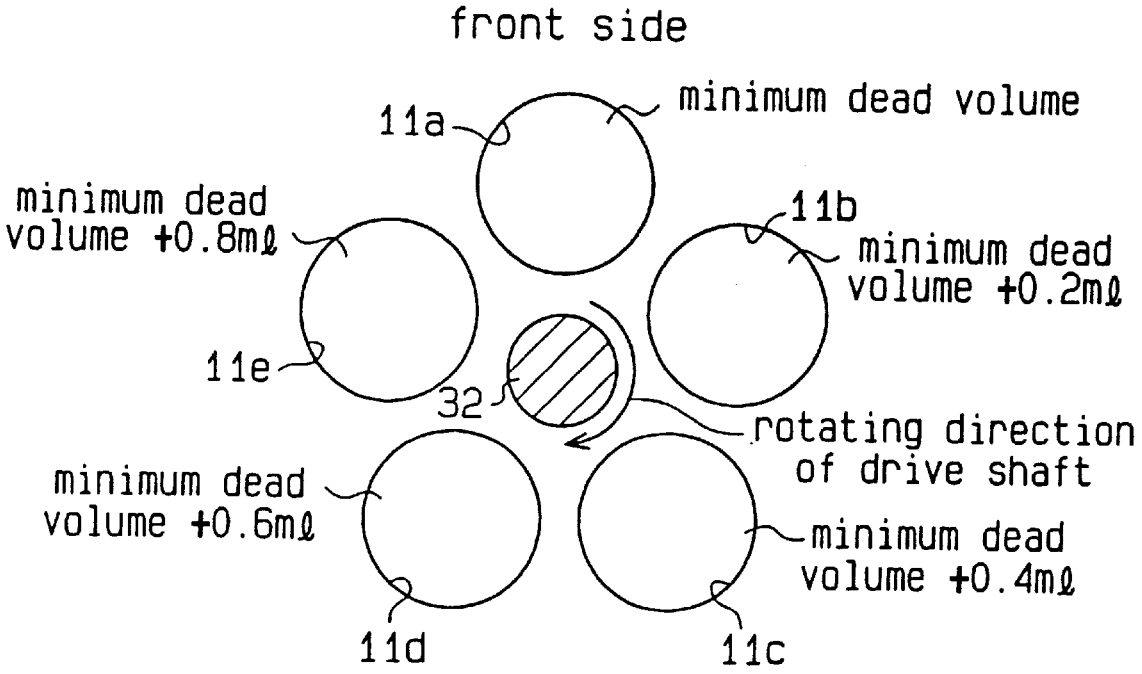
FIG. 8A is a diagrammatic drawing showing the dead volume of each compression chamber at the front side of a compressor according to a third embodiment of the present invention.

As shown in FIG. 8A, the dead volume in the compression chamber 29 of the first front cylinder bore 11*a* is the smallest. The reference volume of this compression chamber 30 is exemplified here as 20 ml. The dead volume in each successive front cylinder bore 11*b*–11*e* is increased, for example, by 0.2 ml in the rotating direction of the drive shaft 32.

Figure 8B:
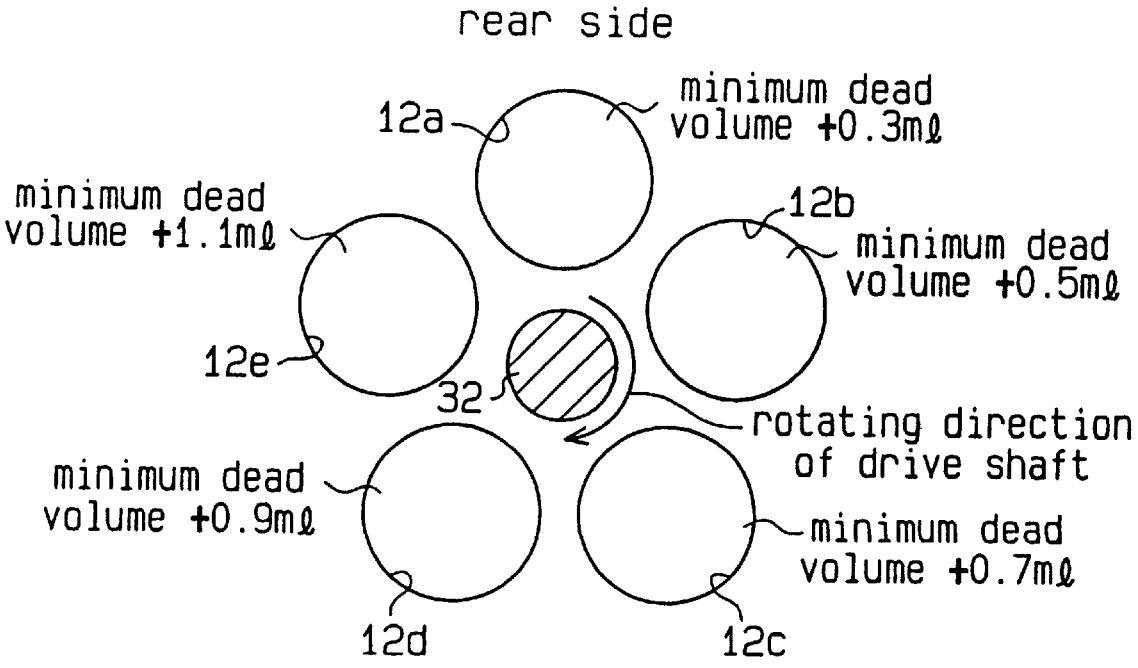
FIG. 8B is a diagrammatic drawing showing the dead volume of each compression chamber at the rear side of a compressor according to the third embodiment of the present invention.

As shown in FIG. 8B, the dead volume in each compression chamber 30 is obtained by adding a constant volume, e.g., 0.3 ml, to the dead volume in the associated front compression chamber 29.

Accordingly, the dead volumes in the associated front and rear compression chambers 29, 30 for each piston differ from each other. Furthermore, the dead volumes in each and every cylinder bore 11*a*–11*e*, 12*a*–12*e* differ from one another. This structure decreases the level of the ten cycle components.

Although several embodiments of the present invention have been described herein, it should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope of the appended claims.

What is claimed is:

1. A compressor for compressing a gas, comprising:

a housing:

a drive shaft rotatably supported by the housing;

a drive plate mounted on the drive shaft;

a plurality of cylinder bores defined in the housing and located around the drive shaft;

a plurality of pistons respectively located in the cylinder bores and operably connected to the drive plate, wherein said drive plate converts rotation of the drive shaft to reciprocating movement of each piston; and a plurality of compression chambers respectively defined in the cylinder bores for compressing the gas supplied to the cylinder bores in accordance with the reciprocating movement of the associated piston, each compression chamber having a dead volume defined by its volume when the associated piston is at a top dead center position, one of the compression chambers having a dead volume that is smaller than that of the other compression chambers, and one of the compression chambers having a dead volume that is larger than that of the other compression chambers, the cylinder bore having the smallest dead volume defining a reference volume when the associated piston is at a bottom dead center position, the dead volume of the chamber having the largest dead volume being greater than the dead volume of the chamber having the smallest dead volume by one or more percent of the reference volume, the chamber having the smallest dead volume being located next to the chamber having the largest dead volume and the other dead volumes of the compression chambers increasing successively between the chamber having the smallest dead volume and the chamber having the largest dead volume.

2. The compressor according to claim 1, wherein the housing includes a front housing and a rear housing, each cylinder bore includes a front cylinder bore formed in the front housing and a rear cylinder bore formed in the rear housing, the front cylinder bore and the rear cylinder bore making a pair, the paired cylinder bores accommodating an associated double-headed piston, which is a double-headed piston, and each of the front and the rear cylinder bores has a compression chamber having a predetermined dead volume.

3. The compressor according to claim 2, wherein the dead volumes at the front side and the rear side of the each pair of cylinder bores are substantially identical in volume.

4. The compressor according to claim 3, wherein the dead volumes of the compression chambers increase successively along a rotational direction of the drive shaft.

5. The compressor according to claim 3, wherein the compressor has five double-headed pistons, the chamber having the smallest dead volume defines the reference volume, and dead volumes of the other compression chambers are expanded from the smallest dead volume by 1%, 2%, 3% and 4% of the reference volume in succession.

6. The compressor according to claim 2, wherein the compressor has five double-headed pistons.

7. The compressor according to claim 2, wherein the front and rear cylinder bores of each pair have a substantially identical shape, and the shape of the associated piston in the front and rear cylinder bores of each pair is different, thereby providing a dead volume having a different size in the front and rear cylinder bores of each pair.

8. The compressor according to claim 2, wherein the front and rear cylinder bores of each pair have a substantially identical shape, and a length of the associated piston in the front and rear cylinder bores of each pair is different, thereby providing a dead volume having a different size in the front and rear cylinder bores of each pair.

9. The compressor according to claim 2, wherein the dead volumes of the front cylinder bores each have predetermined volumes, and a length of the associated piston in each rear cylinder bore of each pair is different from a length of the associated piston in each front cylinder bore of each pair, thereby providing in each rear cylinder bore a dead volume having a different size than the dead volume in the associated front cylinder bore.

10. The compressor according to claim 2, wherein the dead volumes of the front cylinder bores each are predetermined, and the dead volumes of the rear cylinder bores are greater than the dead volumes of the associated front cylinder bores by a constant amount.

11. The compressor according to claim 10, wherein the compressor has five double-headed pistons, and wherein the front compression chamber having the smallest dead volume defines the reference volume, the dead volumes of the other front compression chambers are greater than the smallest front dead volume by 1%, 2%, 3% and 4% of the reference volume in succession, and the dead volume of each of the corresponding rear cylinder bores is greater than the dead volumes of the corresponding front cylinder bores by 0.15% of the reference volume.

12. The compressor according to claim 1, wherein the successive increases in the dead volumes are equal in volume.

13. A compressor for compressing a gas, comprising:

a housing;

a drive shaft rotatably supported by the housing;

a drive plate mounted on the drive shaft;

a plurality of cylinder bores defined in the housing and located around the drive shaft;

a plurality of pistons respectively located in the cylinder bores and operably connected to the drive plate, wherein said drive plate converts rotation of the drive shaft to reciprocating movement of each piston; and a plurality of compression chambers respectively defined in the cylinder bores for compressing the gas supplied to the cylinder bores in accordance with the reciprocating movement of the associated piston, each compression chamber having a dead volume defined by its volume when the associated piston is at a top dead center position, one of the compression chambers having a dead volume that is smaller than that of the other compression chambers, and one of the compression chambers having a dead volume that is larger than that of the other compression chambers, the compression chamber having the smallest dead volume defining a reference volume when the associated piston is at a bottom dead center position, the dead volume of the chamber having the largest dead volume being greater than the dead volume of the chamber having the smallest dead volume by one or more percent of the reference volume, and the dead volumes of the compression chambers varying in the rotational direction of the drive shaft in a regular pattern.

14. The compressor according to claim 13, wherein the housing includes a front housing and a rear housing, each cylinder bore includes a front cylinder bore formed in the front housing and a rear cylinder bore formed in the rear housing, the front cylinder bore and the rear cylinder bore making a pair, the paired cylinder bores accommodating an associated piston of a double headed piston, and each of the front and the rear cylinder bores has a compression chamber having a predetermined dead volume, the dead volumes at the front side and the rear side of each pair of cylinder bores being substantially identical in volume.

15. The compressor according to claim 14, wherein the compressor has five double-headed pistons, the chamber having the smallest dead volume defines the reference volume, and the dead volumes of the other compression chambers are expanded from the smallest dead volume by 1%, 3%, 1% and 3% of the reference volume in succession.

16. A compressor for compressing a gas, comprising:

a front housing and a rear housing;

a drive shaft rotatably supported by the front housing and the rear housing;

a drive plate mounted on the drive shaft;

a plurality of front cylinder bores formed in the front housing and an associated plurality of rear cylinder bores formed in the rear housing, around the drive shaft, a front cylinder bore and an associated rear cylinder bore making a pair;

a plurality of double-headed pistons, each one of the double-headed pistons being located in a respective front and rear cylinder bore, the double-headed pistons being operably connected to the drive plate, wherein said drive plate converts rotation of the drive shaft to reciprocating movement of each piston; and a plurality of compression chambers respectively defined in the cylinder bores for compressing the gas supplied to the cylinder bores in accordance with the reciprocating movement of the associated piston, each compression chamber having a dead volume defined by its volume when the associated piston is at a top dead center position, one of the compression chambers having a dead volume that is smaller than that of the other compression chambers, and one of the compression chambers having a dead volume that is larger than that of the other compression chambers, the cylinder bore having the smallest dead volume defining a reference volume when the associated piston is at a bottom dead center position, the dead volume of the chamber having the largest dead volume being greater than the dead volume of the chamber having the smallest dead volume by one or more percent of the reference volume, the dead volumes of the front cylinder bores each having predetermined volumes, and respective lengths of the associated pistons in the front and rear cylinder bores being different from each other, thereby providing dead volumes having different sizes in the front and rear cylinder bores of each pair of cylinder bores.

17. A compressor for compressing a gas, comprising:

a front housing and a rear housing;

a drive shaft rotatably supported by the front housing and the rear housing;

a drive plate mounted on the drive shaft;

a plurality of front cylinder bores formed in the front housing and an associated plurality of rear cylinder bores formed in the rear housing, around the drive shaft, a front cylinder bore and an associated rear cylinder bore making a pair;

a plurality of double-headed pistons, each one of the double-headed pistons being located in a respective front and rear cylinder bore, the double-headed pistons being operably connected to the drive plate, wherein said drive plate converts rotation of the drive shaft to reciprocating movement of each piston; and a plurality of compression chambers respectively defined in the cylinder bores for compressing the gas supplied to the cylinder bores in accordance with the reciprocating movement of the associated piston, each compression chamber having a dead volume defined by its volume when the associated piston is at a top dead center position, one of the compression chambers having a dead volume that is smaller than that of the other compression chambers, and one of the compression chambers having a dead volume that is larger than that of the other compression chambers, the cylinder bore having the smallest dead volume defining a reference volume when the associated piston is at a bottom dead center position, and the dead volume of the chamber having the largest dead volume being greater than the dead volume of the chamber having the smallest dead volume by one or more percent of the reference volume, wherein the dead volumes of each of the front cylinder bores are predetermined, and the dead volumes of the rear cylinder bores are greater than the dead volumes of the associated front cylinder bores by a constant amount.

* * * * *

UNITED STATES PATENT AND TRADEMARK OFFICE
CERTIFICATE OF CORRECTION

PATENT NO. : 5,983,780

DATED : November 16, 1999

INVENTOR(S) : Akira NAKAMOTO et al.

It is certified that error appears in the above-identified patent and that said Letters Patent is hereby corrected as shown below:

On the title page, item "[73] Assignee:", add as a joint assignee:

--Denso Corporation, Aichi-ken, Japan--

On the title page, item [57] ABSTRACT", line 14 thereof, after "at" delete "a" .

Column 6, line 8, after "in" and before "each" delete "of".

Signed and Sealed this

Thirteenth Day of February, 2001

*Attest:*

Nicholas P. Godici

NICHOLAS P. GODICI

*Attesting Officer*

*Acting Director of the United States Patent and Trademark Office*